US008002612B2

(12) United States Patent
Fisher

(10) Patent No.: US 8,002,612 B2
(45) Date of Patent: Aug. 23, 2011

(54) ATTACHMENT SYSTEM FOR A SANDING TOOL

(75) Inventor: Daniel J. Fisher, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1402 days.

(21) Appl. No.: 10/821,071

(22) Filed: Apr. 8, 2004

(65) Prior Publication Data

US 2005/0227600 A1 Oct. 13, 2005

(51) Int. Cl.
*B25D 11/00* (2006.01)
*B25D 15/00* (2006.01)

(52) U.S. Cl. ..... 451/538; 451/490

(58) Field of Classification Search ..... 451/490, 451/538; 24/31 V, 442; 248/690, 205.2
See application file for complete search history.

(56) References Cited

U.S. PATENT DOCUMENTS

| | | | | | |
|---|---|---|---|---|---|
| 2,499,898 | A | | 3/1950 | Anderson | |
| 2,717,437 | A | | 9/1955 | Mestral | |
| 3,009,235 | A | | 11/1961 | Mestral | |
| 3,192,589 | A | | 7/1965 | Pearson | |
| 3,266,113 | A | | 8/1966 | Flanagan, Jr. | |
| 3,408,705 | A | | 11/1968 | Kayser et al. | |
| 3,522,681 | A | * | 8/1970 | Lampert | 451/490 |
| 3,527,001 | A | * | 9/1970 | Zemke et al. | 451/490 |
| 3,875,703 | A | * | 4/1975 | Clemente | 451/359 |
| 3,899,805 | A | | 8/1975 | McMillan | |
| 4,581,792 | A | | 4/1986 | Spier | |
| 4,617,767 | A | * | 10/1986 | Ali | 451/490 |
| 4,846,815 | A | | 7/1989 | Scripps | |
| 4,875,259 | A | | 10/1989 | Appeldorn | |
| 5,071,363 | A | | 12/1991 | Reylek et al. | |
| 5,088,164 | A | | 2/1992 | Wilson et al. | |
| 5,097,570 | A | | 3/1992 | Gershenson | |
| 5,113,555 | A | | 5/1992 | Wilson et al. | |
| 5,201,101 | A | | 4/1993 | Rouser et al. | |
| 5,201,785 | A | * | 4/1993 | Nagano | 451/508 |
| 5,731,056 | A | * | 3/1998 | Butler, III | 428/100 |
| 5,807,161 | A | * | 9/1998 | Manor et al. | 451/442 |
| 5,922,436 | A | * | 7/1999 | Banfield et al. | 428/100 |
| 6,186,878 | B1 | * | 2/2001 | Takizawa et al. | 451/357 |
| 6,210,389 | B1 | * | 4/2001 | Long et al. | 604/391 |
| 6,394,887 | B1 | * | 5/2002 | Edinger | 451/494 |
| 2001/0001088 | A1 | * | 5/2001 | Chesley et al. | 451/538 |
| 2002/0098788 | A1 | | 7/2002 | Edinger | |

FOREIGN PATENT DOCUMENTS

| | | | |
|---|---|---|---|
| DE | 4339110 | A1 * | 5/1995 |
| EP | 0 112 405 | A1 | 7/1984 |
| WO | WO 9519242 | A | 7/1995 |

* cited by examiner

*Primary Examiner* — Bryan R Muller
(74) *Attorney, Agent, or Firm* — David B. Patchett

(57) ABSTRACT

An attachment system for attaching an abrasive article, such as an abrasive sheet or disc, to a sanding tool includes an article having a first major surface including an attachment region with attachment material for attachment with an associated mating surface on the sanding tool, and a non-attachment region along at least a portion of an edge of the first major surface forming a sufficiently weak attachment with the associated mating surface to allow a user to grasp the abrasive article and separate the abrasive article from the sanding tool.

7 Claims, 7 Drawing Sheets

ATTACHMENT SYSTEM FOR A SANDING TOOL

FIELD OF THE INVENTION

The present invention relates generally to sanding tools such as edger sanders or random orbit sanders and, more particularly, to an attachment system that allows an abrasive article to be easily attached to or separated from the sanding tool.

BACKGROUND OF THE INVENTION

Sanding machines and power tools are commonly used to sand and/or refinish hardwood floors. An edger sander is a power tool used to sand the perimeter region of a floor or any other areas of a floor that cannot be sanded by a larger sanding machine such as a drum or belt type sander.

Edger sanders use abrasive articles, such as abrasive sheets or discs, to strip coatings, level, and smooth scratches from all types of wood flooring prior to applying a coating, such as urethane, to the floor. Abrasive sheets and discs are available in a wide variety of sizes, shapes, and abrasive particle sizes (referred to by grit number). When using abrasive articles in the form of "sheet goods", i.e. abrasive sheets and discs, a back-up pad is often used to mount or attach the abrasive article to the edger sander. In the past, abrasive discs were bolted to the back-up pad of the edger sander by hand or using a wrench. Such an attachment system, however, made replacement of the abrasive discs unnecessarily laborious and time consuming.

More recently, hook and loop attachment systems have been provided to allow the abrasive discs to be more easily attached to and removed from the back-up pad. Conventional back-up pads, however, typically include a face that does not provide a suitable mating surface for a hook or loop type of attachment system. Consequently, abrasive articles having a hook and loop attachment system cannot be attached directly to the back-up pad, but require a back-up pad having a face modified to provide an attachment surface for a hook and loop type attachment system. This is typically accomplished with a conversion pad that is attached to the face of the back-up pad to provide the back-up pad with a mating surface for the hook and loop attachment surface of the abrasive article.

Because of the limited finger gripping space between the abrasive article and attachment surface of the back-up pad or conversion pad, however, removal of the abrasive article can be difficult. In addition, the sanding operation tends to cause the hook and loop attachment to mesh aggressively, making separation more difficult.

SUMMARY OF THE INVENTION

As a result, the need exists for an attachment system that allows an abrasive article to be quickly and easily attached to and removed from a back-up pad. In particular, the need exists for a conversion pad that allows an abrasive article to be quickly and easily attached to and removed from the conversion pad.

It would also be desirable to provide a conversion pad that allows an abrasive article to be quickly and easily removed from the conversion pad, wherein the conversion pad provides uniform support for the entire surface area of the abrasive article, thereby providing a consistent and uniform abrasive surface for sanding a work surface. It would also be desirable to provide a conversion pad that allows an abrasive article to be quickly and easily removed from the conversion pad, wherein the conversion pad allows the abrasive article to sand the work surface adjacent an edge.

The invention overcomes the above-identified limitations in the field by providing an attachment system for attaching an abrasive article, such as an abrasive sheet or disc, to a sanding tool that allows the abrasive article to be quickly and easily removed from the sanding tool. The attachment system includes a first major surface including an attachment region with attachment material for attachment with an associated mating surface, and a non-attachment region along at least a portion of an edge of the first major surface that forms an attachment with the associated mating surface that is weaker than the connection between the attachment region and the associated mating surface. That is, the force required to separate the non-attachment region from the associated mating surface is less than the force required to separate the attachment region from the associated mating surface. The connection between the non-attachment region and the associated mating surface is preferably sufficiently weak to allow a user to manually grasp the abrasive article in the area adjacent the non-attachment region and separate the abrasive article from the sanding tool.

In one embodiment, the attachment system comprises a first major surface of a conversion pad and the conversion pad has a second major surface opposite the first major surface adapted to engage the sanding tool. The associated mating surface may comprise a first major surface of the abrasive article, which includes an abrasive second major surface opposite the first major surface for abrading a work surface.

In a specific embodiment, the present invention provides a conversion pad for attaching an abrasive article to a back-up pad. The conversion pad comprises a pad having first and second opposed major surfaces, the first major surface being adapted for engagement with the back-up pad and the second major surface including an attachment surface including attachment material for attaching the conversion pad with the abrasive article. The non-attachment surface extends along at least a portion of an edge region of the second surface, thereby to allow a user to grasp the abrasive article and separate the abrasive article from the conversion pad.

In an alternate embodiment, the present invention provides an abrasive article for attachment to a conversion pad. The abrasive article comprises a sheet having first and second opposed major surfaces. The first major surface includes abrasive for abrading a work surface and the second major surface includes an attachment surface including attachment material for attaching the abrasive article to the conversion pad and a non-attachment surface along at least a portion of an edge region of the second surface, thereby to allow a user to grasp the abrasive article and thereby separate the abrasive article from the conversion pad.

In another particular embodiment, the present invention provides an abrading tool, such as an edger sander, including a back-up pad, a conversion pad connected with the back-up pad, and an abrasive article connected with the conversion pad, wherein the conversion pad comprises a pad having first and second opposed major surfaces, the first major surface including abrasive for abrading a work surface and the second major surface including an attachment surface including attachment material for attaching the conversion pad with the abrasive article and a non-attachment surface along at least a portion of an edge region of the second surface, thereby to allow a user to grasp the abrasive article and separate the abrasive article from the conversion pad.

In another embodiment, the present invention provides the combination of a conversion pad and an abrasive article, the conversion pad and abrasive article including mating surfaces defining an attachment area and non-mating surfaces defining a non-attachment area. The non-attachment area is provided along at least a portion of an adjacent edge region between the conversion pad and the abrasive article, thereby to allow a user to grasp the abrasive article and separate the abrasive article from the conversion pad.

In a particular aspect, the non-attachment region comprises a continuous edge region extending around the entire perimeter of the first major surface. In another aspect, the attachment surface comprises a plurality of mechanical fastening elements. In a more particular aspect, the mechanical fastening elements comprise hook-type fastening elements.

In another aspect, the first major surface of the back-up pad, conversion pad, or abrasive article is circular and the non-attachment region comprises an annular region extending around the entire perimeter of the first major surface.

In another aspect of the invention, the non-attachment region includes fastening elements that have been altered to inhibit attachment of the fastening elements with the associated mating surface. In various aspects of the invention, the fastening elements are removed, bent, crushed, melted, or otherwise altered to prevent attachment of the fastening elements with the associated mating surface. In another embodiment of the invention, the attachment material comprises adhesive.

In yet another aspect of the invention, the non-attachment region includes a coating material applied to the fastening elements to inhibit attachment of the fastening elements to an associated mating surface. The coating may be a sheet of material applied to the terminal ends of the fastening elements, thereby covering the fastening elements and preventing the fastening elements from attaching to an associated attachment surface, or a hardenable liquid applied to fill the open space around the fastening elements, thereby preventing the fastening elements from attaching to an associated attachment surface. The non-attachment region may also be free of attachment material.

In a particular aspect, the attachment region and the non-attachment region are co-planar to provide a uniform abrading surface. The conversion pad and the abrasive article may also have substantially the same profile and have aligned outer edges.

In another embodiment, the attachment system comprises a major surface of the abrasive article and the abrasive article has a second major surface opposite its first major surface including abrasive for abrading a work surface.

In various aspects, the associated mating surface comprises a surface of at least one of a conversion pad, a back-up pad, an abrasive article, and a block sander. In a particular aspect, the attachment surface comprises a loop-type fabric material adapted to mate with an associated mating surface comprising hoop-type fastening elements.

The present invention is not limited to any particular type of sanding tool and may include power sanding tools, such as edger sanders and orbital sander, and manual block sanders. It is particularly applicable to sanding tools used to sand edge regions of a work surface, such as where a hardwood floor abuts a wall, because it allows an abrasive article to abrade the work surface adjacent the abutting surface without damaging the abutting surface.

An advantage of certain embodiments of the invention is that the abrasive article can be readily separated from the conversion pad to allow a user to replace the abrasive article. Another advantage of certain embodiments of the invention is that the abrasive article is uniformly supported by the conversion pad, thereby providing a consistent and uniform abrading surface for abrading the work surface. Yet another advantage of certain embodiments is that the edges of the abrasive article and conversion pad are aligned, thereby allowing a work surface, such as a hardwood floor, to be sanded immediately adjacent an abutting surface, such as a wall.

BRIEF DESCRIPTION OF THE DRAWINGS

The present invention will be further described with reference to the accompanying drawings, in which.

DETAILED DESCRIPTION

Figure 1:
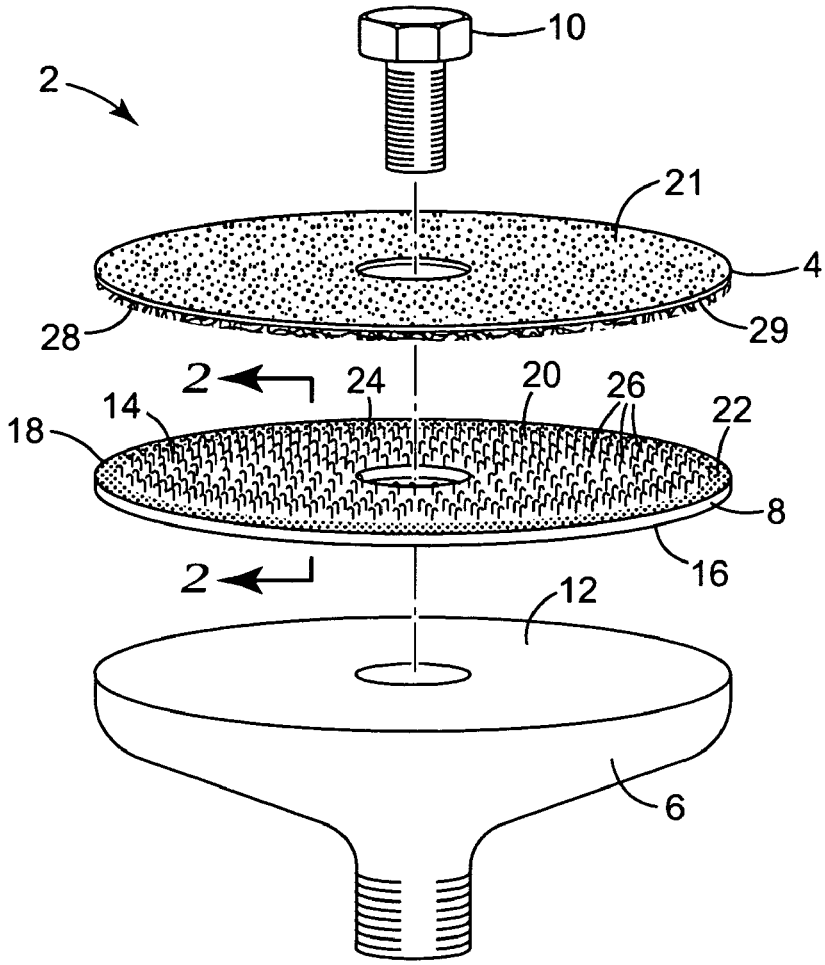
FIG. 1 is an exploded view of an abrasive article attached to a back-up pad using an attachment system according to the invention.

Referring now to the drawings, wherein like reference numerals refer to like or corresponding parts throughout the several views, FIG. 1 shows an assembly 2 for attaching an abrasive article 4 to a sanding tool (not shown). The assembly 2 includes a back-up pad 6, a conversion pad 8 secured to the back-up pad with a bolt 10, and an abrasive article 4, such as an abrasive sheet or disc, which is attached to the conversion pad 8 in the manner described below.

The back-up pad 6 has an engagement face 12 against which the conversion pad 8 is placed. Bolt 10 secures the conversion pad 8 against the engagement face 12. The bolt also allows the conversion pad 8 to be removed from the back-up pad 6 and be replaced periodically, if necessary. It will be recognized that other securing means, such as adhesive, may be used to attach the conversion pad 8 to the back-up pad 6. The back-up pad 6 is depicted generically to represent a wide variety of back-up pads and is not limited to a back-up pad having a particular size, shape, or material for its construction.

The conversion pad 8 is secured to the back-up pad 6 to enable the back-up pad 6 to be used with an abrasive article 4 having an attachment system that could not otherwise be attached to the engagement face 12 of the conversion pad 8.

Figure 2:
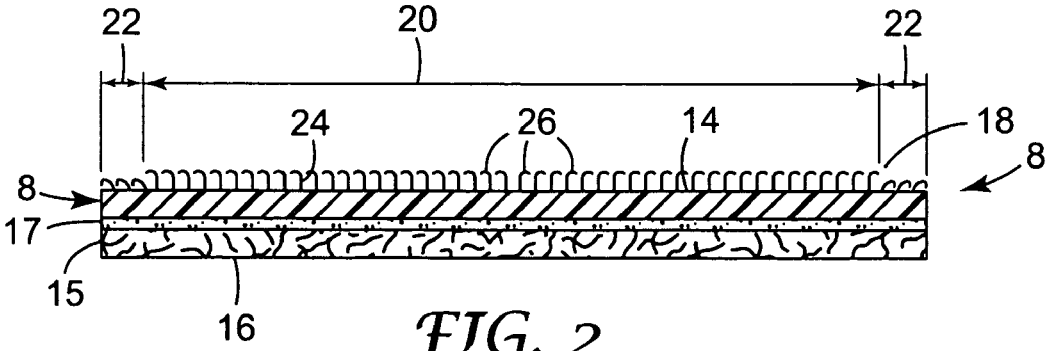
FIG. 2 is a sectional view of the conversion pad of FIG. 1.

Referring now to FIGS. 1 and 2, the conversion pad 8 includes a first major surface 14 that attaches to the abrasive article 4, and an opposed second major surface 16 that engages the engagement face 12 of the back-up pad 6. The first major surface 14 includes a plurality of hook-type fastening elements 26. When secured to the engagement face 12, the conversion pad 8 provides the back-up pad 6 with a new mating surface, namely surface 14, that can be used to attach the abrasive article 4 to the back-up pad 6.

The conversion pad 8 includes a backing 15 that serves to increase the structural integrity and durability of the conversion pad 8. The backing may be, for example, a layer of vulcanized fiber board that is adhesively bonded to the conversion pad 8 with a layer of hot melt adhesive 17.

The abrasive article 4 includes a first major surface 28 comprising an associated mating surface 28 for engagement with the first major surface 14 of the conversion pad 8, and an abrasive second major surface 21 opposite the first major surface for abrading a work surface such as a hardwood floor (not shown). The abrasive article 4 and the conversion pad 8 preferably have substantially the same size and shape, and have matching profiles such that their outer peripheral edges are aligned. In this manner, the conversion pad 8 does not interfere with the abrasive article's ability to sand along the edge of a work surface that abuts another surface. That is, by aligning the outer edges of the conversion pad 8 and abrasive article 4, the abrasive article 4 can effectively sand the area immediately adjacent an abutting surface, such as a wall, without damaging the wall.

In accordance with a characterizing feature of the invention, the first major surface 14 of the conversion pad 8 includes an attachment system 18 comprising an interior attachment region 20 and a peripheral non-attachment region 22. The attachment region 20 includes attachment material 24 for removably connecting the abrasive article 4 with the conversion pad 8. The connection between the abrasive article 4 and the conversion pad 8 should securely attach the abrasive article 4 with the conversion pad 8 and should resist relative movement between the abrasive article 4 and conversion pad 8 during use, but should permit the abrasive article 4 to be removed from the conversion pad 8 with a relatively small amount of force.

In the illustrated embodiment, the attachment material 24 includes a plurality of outwardly projecting fastening elements 26 that releasably engage the associated mating surface 28 of the abrasive article 4. The associated mating surface 28 includes loop fabric 29 that may be knitted loop, warp knitted loop fabric, stitched loop fabric, or woven loop fabric having loops that releasably engage the fastening elements 26, and thereby attach the abrasive article 4 with the conversion pad 8.

It will be recognized that the attachment material 24 and associated mating surface 28 may comprise a variety of suitable mechanical fasteners including hook-type fastening elements that mate with loop-type mating material, self-mating profile extruded fasteners having a plurality of intermeshing, or interengaging elements or fasteners such as mushroom shaped fasteners elements, or other known fasteners.

If the fastening elements 26 are self-mating, i.e., capable of interlockingly engaging other fastening elements having an identical or substantially similar structure, the associated mating surface 28 of the abrasive article 4 is provided with the same fastening elements as the conversion pad 8 first major surface 14. The fastening elements 26 are preferably refastenable, i.e., once a fastening element has been connected with a mating surface, it can be pulled away without destroying its ability to connect again with the same mating surface or another mating surface.

Suitable fasteners may take on a variety of forms. One exemplary type includes the hook-and-hook fastener described in U.S. Pat. No. 2,717,437 (de Mestral), the hook-and-loop described in U.S. Pat. No. 3,009,235 (de Mestral), and the headed stem or mushroom-and-loop further described in U.S. Pat. No. 4,846,815 (Scripps).

Another grouping of fasteners using a multiplicity of engaging elements are those that predominantly have solid protrusions including a stem and an expanded region or head at the stem tip. The expanded region or head can have a wide variety of shapes. Normally these fasteners are self-mating wherein the head portion is larger in diameter or cross section than is the space between heads. Exemplary patents describing this type of fastener include, for example, U.S. Pat. No. 2,499,898 (Anderson); U.S. Pat. No. 3,192,589 (Pearson); U.S. Pat. No. 3,266,113 (Flanagan, Jr.); U.S. Pat. No. 3,408,705 (Kayser et al.); and U.S. Pat. No. 5,097,570 (Gershenson).

U.S. Pat. No. 3,899,805 (McMillan) teaches the use of headed hollow protrusions. This type of fastener includes an expanded region fitting into a seat above which is a reduced cross section or restricted pocket and/or by flexing of the stem. Joining of this type of fastener is normally associated with a single or double snap as the fastener is seated.

Another type of fastener having a multiplicity of intermeshing solid protrusions is described in U.S. Pat. No. 4,875,259 (Appeldorn). In this type of fastener, the tips of the protrusions are not expanded or headed. The bond is created by the frictional forces generated between contacting surfaces of the intermeshing protrusions where the surfaces are optically smooth flats. Additional examples of fasteners in this grouping can be found in U.S. Pat. No. 5,071,363 (Reylek et al.); U.S. Pat. No. 5,088,164 (Wilson et al.); U.S. Pat. No. 5,113,555 (Wilson et al.); and U.S. Pat. No. 5,201,101 (Rouser et al.). A fastener based on projections that perforate the web and alternate in rows from one side of the web to the other is disclosed in U.S. Pat. No. 4,581,792 (Spier). This fastener functions by engaging the projections in the receptacles to form a releasable friction fit.

In the embodiment illustrated in FIGS. 1 and 2, the non-attachment region 22 comprises an annular region circumscribing the entire perimeter of the second major surface 14. This arrangement eliminates the need for the user to find the particular location of the non-attached portion of the abrasive article 4 during the removal process. Instead, the user can grasp the abrasive article 4 at any location along the entire circumference of the conversion pad 8.

It will be recognized, however, that the non-attachment region 22 may comprise a variety of shapes and sizes so long as it includes an edge portion of the first major surface 14 and provides the described function of allowing a user to grasp the abrasive article 4 and readily separate the abrasive article 4 from the first major surface 14 of the conversion pad 8.

Figure 3A:
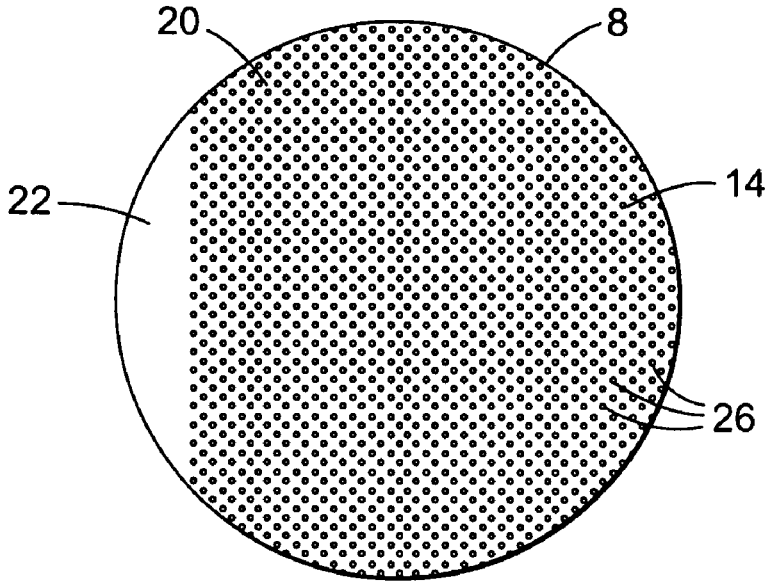
FIG. 3*a* is a plan view of a second embodiment of the invention.
Figure 3B:
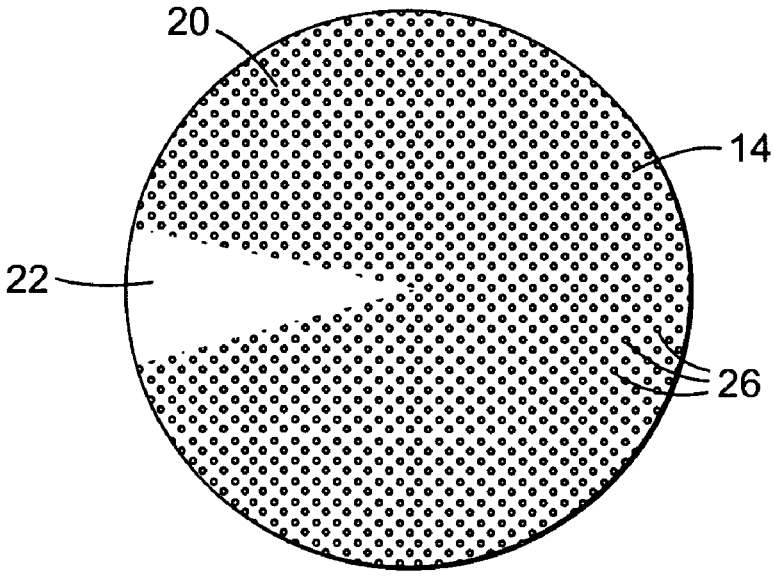
FIG. 3*b* is a plan view of a third embodiment of the invention.

FIGS. 3*a* and 3*b* show two possible alternate arrangements of the non-attachment region 22. In FIG. 3*a*, the non-attachment region 22 comprises a semi-circular region defined by an arc extending along a length of the circumference of the conversion pad 8 and a line extending between the opposite ends of the arc. Fastening elements 26 are provided on the remainder of the surface 14 which comprises the attachment region 20. Arranged in this manner, when an abrasive article is attached to the conversion pad 8, the portion of the abrasive article arranged adjacent the non-attachment region 22 forms a pull tab or flap that can be manually grasped and pulled by a user to separate and remove the abrasive article from the conversion pad 8. In FIG. 3*b*, the non-attachment region 22 comprises a pie-shaped slice of the first major surface 14. The remaining attachment region 20 is provided with fastening elements 26. Others patterns or arrangements of the attachment 20 and non-attachment 22 regions within the scope of the invention will be apparent to those skilled in the art.

The non-attachment region 22 may be formed a number of ways. For example, if the first major surface 14 of the conversion pad 8 (including both the attachment region 20 and the non-attachment region 22) is provided with fastening elements 26, the non-attachment region 22 may be formed by modifying the fastening elements 26 in the non-attachment region 22 by removing, crushing, bending, melting or otherwise altering the structure of the fastening elements 26 themselves to inhibit their ability to attach to an associated mating surface 28.

Figure 4A:
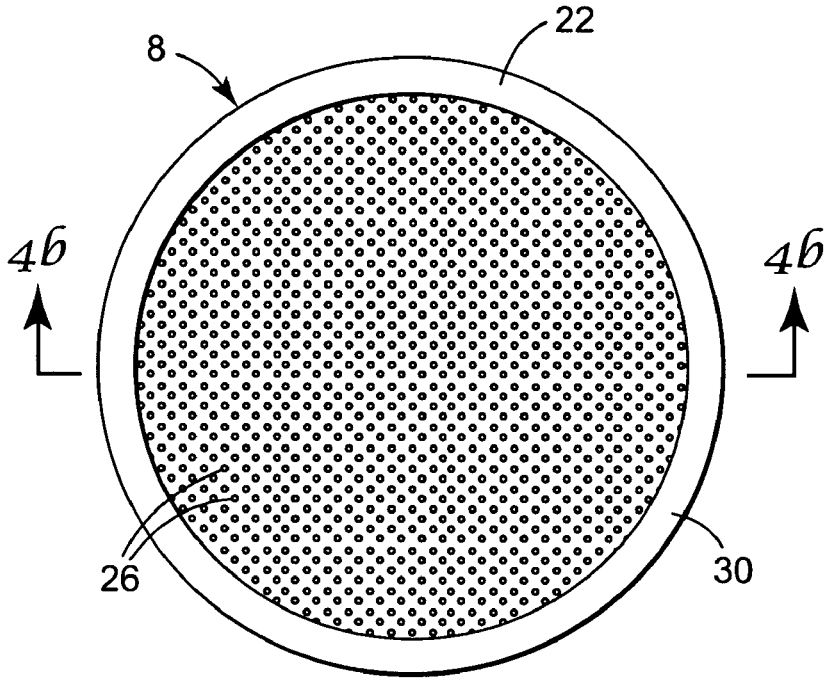
FIG. 4*a* is a plan view of a fourth embodiment of the invention.
Figure 4B:
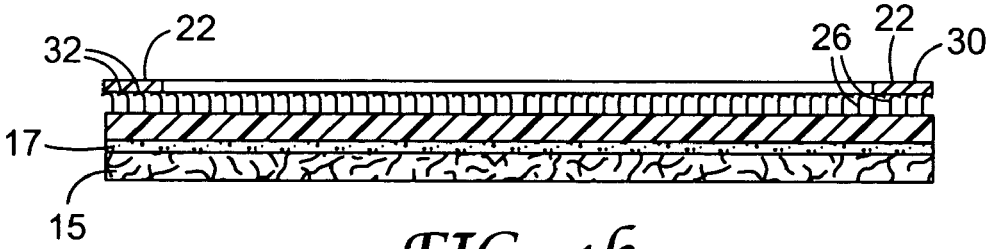
FIG. 4*b* is a sectional view taken along line 4*b*-4*b* of FIG. 4*a;*

As shown in FIGS. 4*a* and 4*b*, the non-attachment region 22 may also be formed by covering the fastening elements 26 with a sheet material 30 to prevent the fastening elements 26 from attaching to the associated mating surface 28. The sheet material 30 may be, for example, a sheet of polymeric material including an adhesive surface that is adhesively affixed to the terminal ends 32 of the fastening elements 26

Figure 5A:
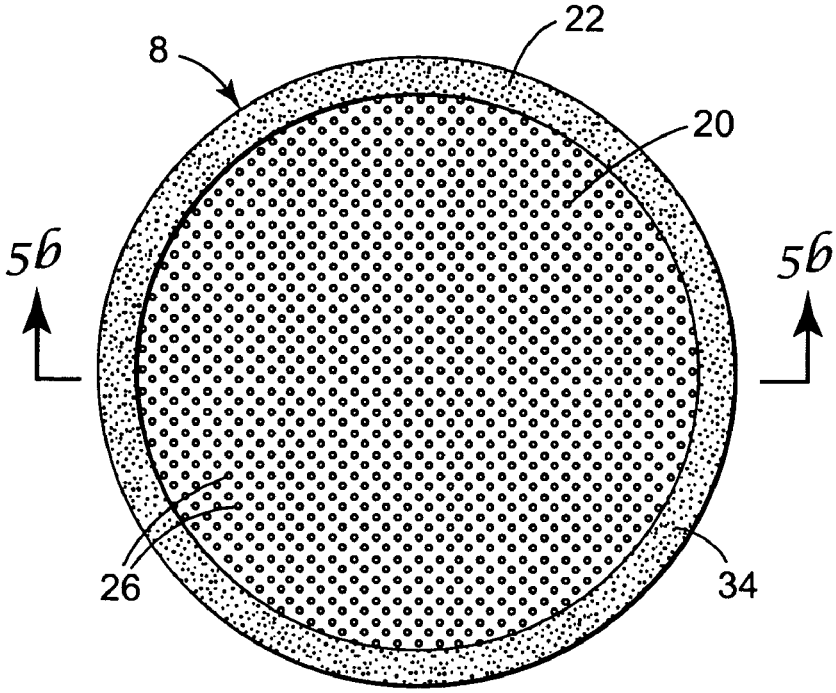
FIG. 5*a* is a plan view of a fifth embodiment of the invention.
Figure 5B:
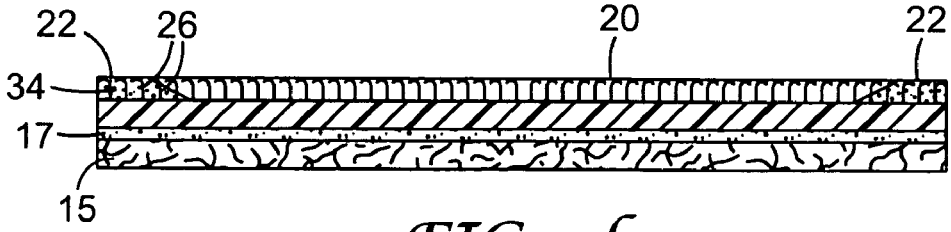
FIG. 5*b* is a sectional view taken along line 5*b*-5*b* of FIG. 5*a;*

FIGS. 5*a* and 5*b* show another embodiment in which the non-attachment region 22 is formed by coating the fastening elements 26 with a hardenable liquid 34, such as an epoxy, that fills the open space around the fastening elements 26 up to the height of the hook portion of the fastening elements 26, and thereby prevents the fastening elements 26 from attaching to the associated mating surface 28.

Figure 6A:
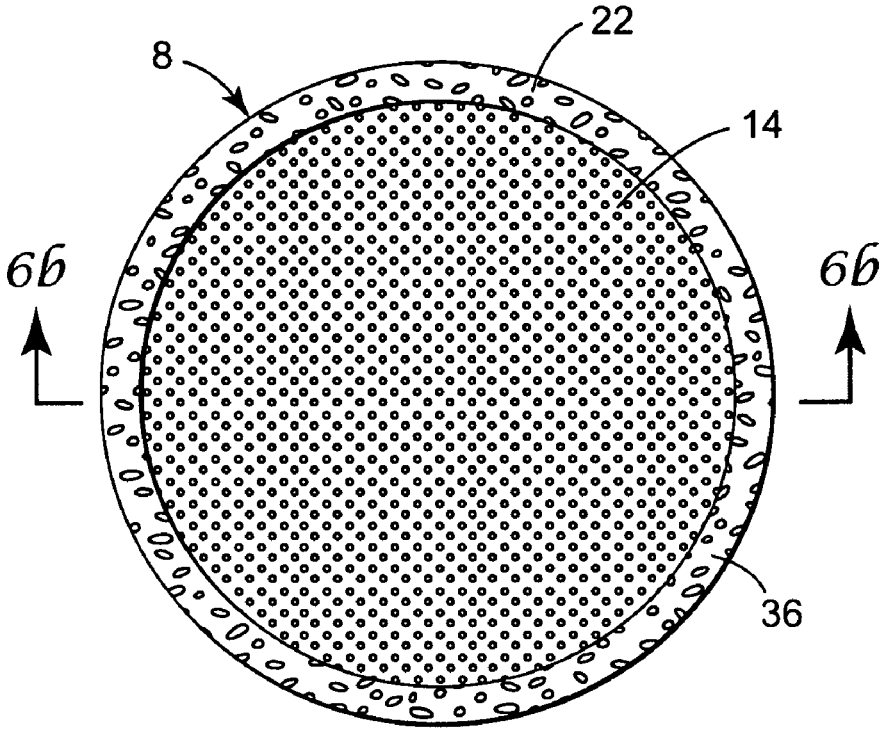
FIG. 6*a* is a plan view of a sixth embodiment of the invention.
Figure 6B:
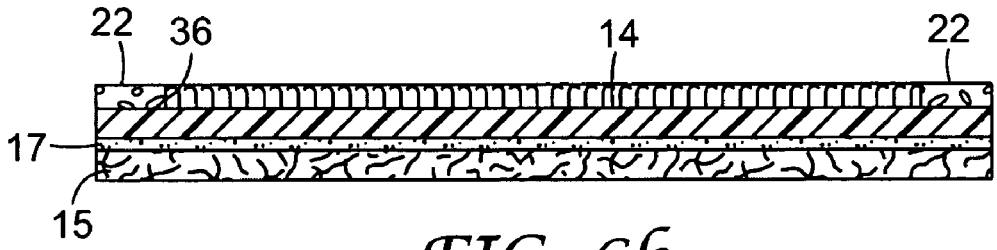
FIG. 6*b* is a sectional view taken along line 6*b*-6*b* of FIG. 6*a;*

The non-attachment region 22 may also be created by simply forming the non-attachment region 22 without any fastening elements 26. This technique, however, can lead to an uneven support surface for the abrasive article, which may result in reduced sanding performance of the abrasive article. Thus, it may be desirable to build up the non-attachment region 22 so it has the same height as the attachment region 20, whereby the attachment region and non-attachment region are essentially coplanar. As shown in FIGS. 6*a* and 6*b*, this can be accomplished by providing the non-attachment region 22 with a lip or ridge 36. As illustrated, the lip 36 is formed by attaching a piece of compressible resilient foam to the non-attachment region 22 of the first major surface 14. Alternatively, the lip 36 may be molded integrally as part of the conversion pad 8.

Figure 7A:
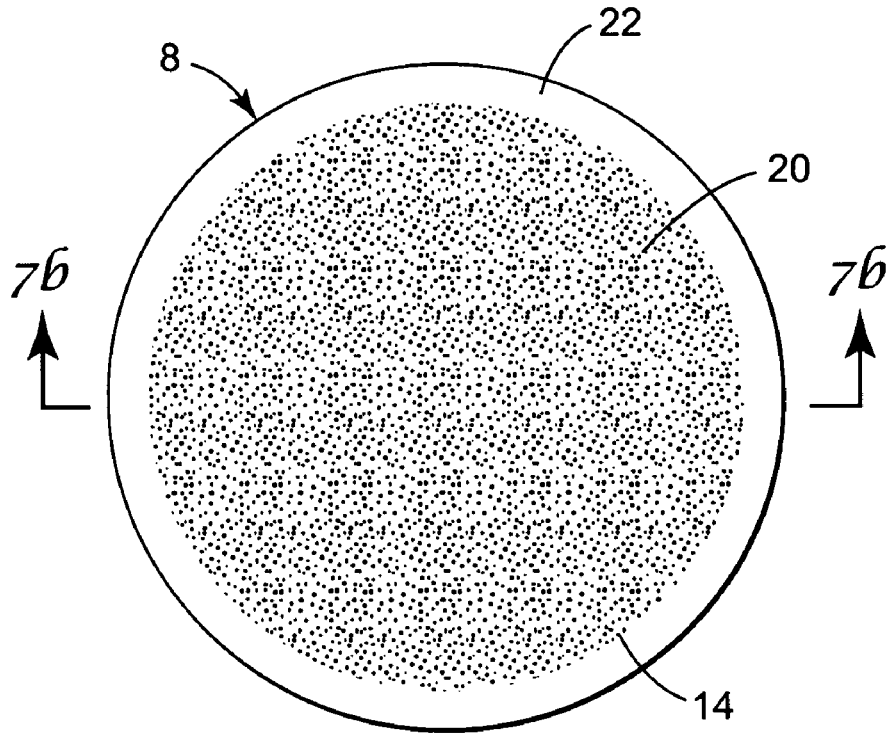
FIG. 7*a* is a plan view of a seventh embodiment of the invention.
Figure 7B:
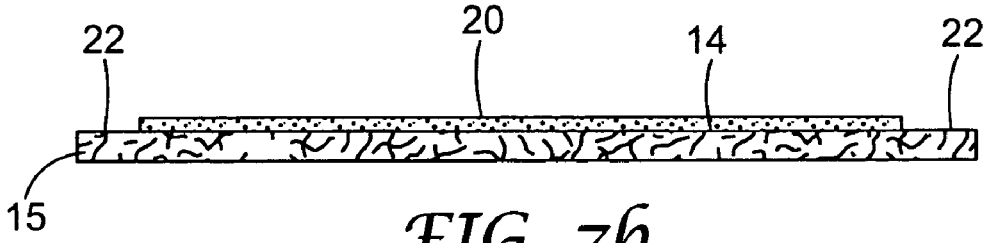
FIG. 7*b* is a sectional view taken along line 7*b*-7*b* of FIG. 7*a;*

It will be recognized that other techniques, such as adhesives, may be used to attach the abrasive article 4 to the conversion pad 8. As shown in FIGS. 7*a* and 7*b*, for example, the attachment region 20 may comprise adhesive and the non-attachment region 22 may comprise a non-adhesive area. A suitable adhesive is Post-It® Note brand repositionable adhesive available from the 3M Company, St. Paul, Minn.

If the entire first major surface 14 of the conversion pad 8 is initially adhesive, the non-attachment region 22 may be rendered non-adhesive using a conventional treatment such as by coating it with a suitable film, paper, powder, foam or ink. Alternatively, if the conversion pad 8 is formed using a non-adhesive backing that is then coated with adhesive, the non-attachment region 22 may be made non-adhesive by simply not coating the non-attachment region 22 with adhesive.

It will be recognized that the non-attachment region 22 in the various embodiments of the invention, but does not necessarily, completely eliminate attachment between the abrasive article 4 and the conversion pad 8. Rather, the non-attachment region 22 need only inhibit attachment between the abrasive article 4 and conversion pad 8 to a sufficient degree to allow a user to readily separate the abrasive article 4 from the conversion pad 8 in the area of the non-attachment region 22 so the user can grasp the abrasive article 4 to effect removal of the abrasive article 4 from the attachment region 20 of the conversion pad 8.

In one aspect of the invention, the connection formed between the non-attachment region 22 and the associated mating surface 28 is weaker than the connection formed between the attachment region 22 and the associated mating surface 28. That is, the force required to separate the abrasive article 4 from the conversion pad 8 is less in the non-attachment region 22 than in the attachment region 20. To facilitate removal, the abrasive article 4 is preferably not attached to the conversion pad 8 in the non-attachment region, or is only loosely attached, thereby allowing a user to readily separate an edge portion of the abrasive article 4 from the conversion pad 8. The separated edge portion can, in turn, be firmly grasped by the user and serves as a starting point for generating a peel force that separates attachment region 22 from the associated mating surface 28.

Figure 8:
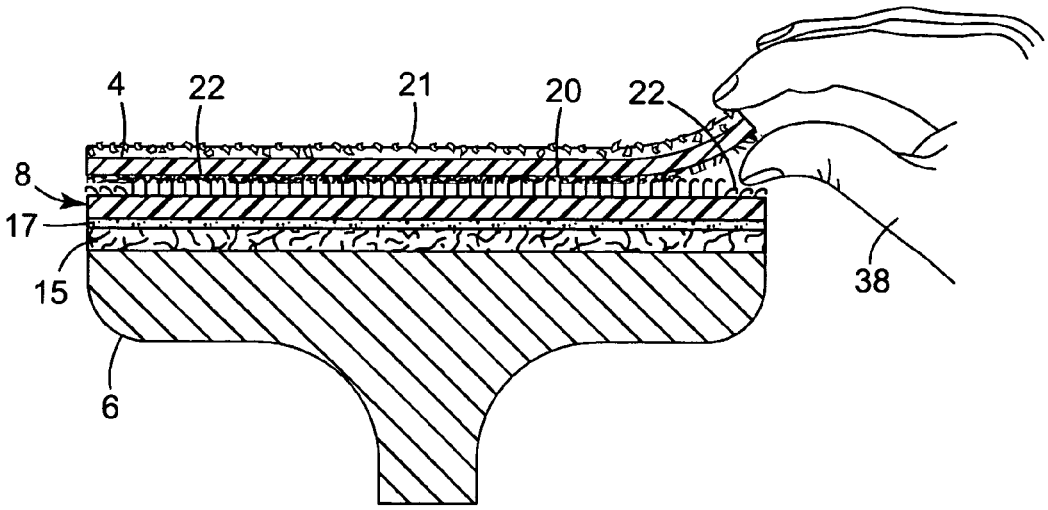
FIG. 8 is a sectional view showing an abrasive article being removed from the conversion pad of FIG. 2.

FIG. 8 illustrates the removal of the abrasive article 4 from the conversion pad 8 shown in FIGS. 1 and 2. As shown, the abrasive article 4 that overlaps the annular circumferential edge portion of the conversion pad 8, which comprises the non-attachment region 22, is either not attached to the non-attachment region 22 or is only loosely attached thereto, thereby allowing a user to use his or her hand 38 to grasp the edge portion of the abrasive article 4 at any point along the circumference of the abrasive article 4. The user can then peel the abrasive article 4 away from the attachment region 20 to completely separate the abrasive article 4 from the conversion pad 8. In this manner, the non-attachment region 22 facilitates separation of the abrasive article 4 from the conversion pad 8 by providing a pull tab that allows a user to readily grasp the abrasive article 4 and separate the abrasive article 4 from the conversion pad 8.

Figure 9A:
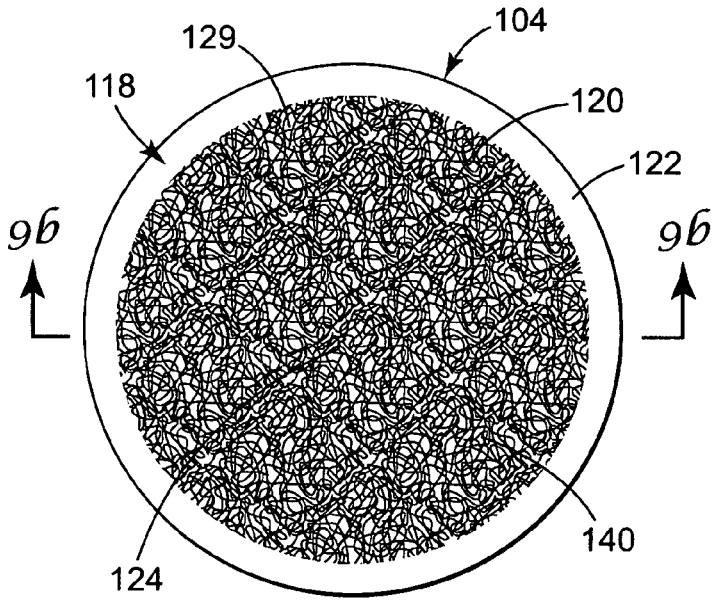
FIG. 9*a* is a plan view of an eighth embodiment of the invention.
Figure 9B:
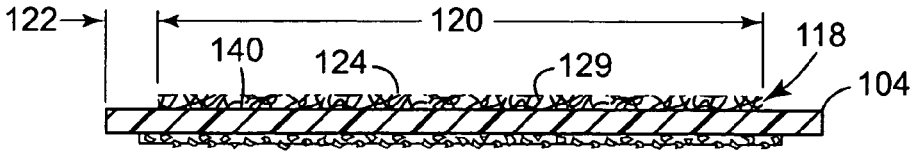
FIG. 9*b* is a sectional view taken along line 9*b*-9*b* of FIG. 9*a.*

FIGS. 9*a* and 9*b* show another embodiment of the invention in which the attachment system 118 is provided on the abrasive article 104 instead of the conversion pad 8. In FIGS. 9*a* and 9*b*, features that are functionally similar to those of FIGS. 1-8 are referred to with like reference numerals incremented by 100. The first major surface 140 of the abrasive article 104 includes an interior attachment region 120 and an annular peripheral non-attachment region 122. The attachment region 120 includes attachment material 124 for removably connecting the abrasive article 104 with the conversion pad 8. In the illustrated embodiment, the attachment material 124 comprises loop-type fabric 129. Other attachment material, however, such as those described previously with respect to attachment material 24 and associated mating surface 28 may be used. It will be recognized that the attachment region 120 may comprise an adhesive and that the non-attachment region 122 may comprise a non-adhesive region. A suitable adhesive is Post-It® Note brand repositionable adhesive available from the 3M Company, St. Paul, Minn.

The non-attachment region 122 region comprises an annular region extending around the entire perimeter of the first major surface 140. The non-attachment region 122 may include attachment material 124 that has been covered, coated, or otherwise altered to inhibit attachment of the non-attachment region 122 with an associated mating surface on the conversion pad in a manner similar to that described above with non-attachment region 22 of the conversion pad 8. Alternatively, the non-attachment region 122 may also be created by simply forming the non-attachment region 122 without attachment material 124 or by removing the attachment material 124 from a selected region or regions of the abrasive article 104 first major surface 140.

It will be apparent to those of ordinary skill in the art that various changes and modifications may be made without deviating from the inventive concept set forth above. For example, the abrasive article and conversion pad may have a variety of sizes and shapes including a square, a triangle, a rectangle an oval, a pentagon, a hexagon, an octagon, and the like. In addition, it will be recognized that any of the attachment systems described above as being provided on the conversion pad may be provided on the abrasive article. That is, the arrangement of the attachment system 18 and the associated mating surface 28 may be reversed. Thus, the scope of the present invention should not be limited to the structures described in this application, but only by the structures described by the language of the claims and the equivalents of those structures.

What is claimed is:

1. A conversion pad for attaching an abrasive to a sanding tool, said conversion pad comprising first and second opposed major surfaces, said first major surface being adapted for engagement with a back-up pad of said sanding tool and said second major surface including an attachment surface including attachment material for attaching said conversion pad with an abrasive article and a non-attachment surface along at least a portion of an edge region of said second surface, thereby to allow a user to grasp the abrasive article and separate the abrasive article from the conversion pad, wherein said attachment surface and said non-attachment surface each terminate opposite said first major surface, and further wherein said attachment and non-attachment surfaces are co-planar opposite said first major surface.

2. A conversion pad as defined in claim 1, wherein said non-attachment region comprises a continuous edge region extending along the entire perimeter of said second surface.

3. A conversion pad as defined in claim 1, wherein said attachment surface comprises a plurality of mechanical fastening elements.

4. A conversion pad as defined in claim 3, wherein said mechanical fastening elements comprise hook-type fastening elements.

5. A conversion pad as defined in claim 4, wherein said conversion pad is circular and said non-attachment region comprises an annular region extending along the entire perimeter of said second surface.

6. A conversion pad as defined in claim 5, wherein said non-attachment region includes fastening elements that have been altered to inhibit attachment of the conversion pad with the abrasive pad.

7. A conversion pad as defined in claim 6, wherein the conversion pad and the abrasive article have substantially the same profile and have aligned outer edges.

* * * * *